US007047842B1

(12) United States Patent
Lee

(10) Patent No.: US 7,047,842 B1
(45) Date of Patent: May 23, 2006

(54) PAWL MECHANISM OF A RATCHET WRENCH

(76) Inventor: Chang Chuan Lee, No. 429, Jhongiheng Rd., Caotun Township, Nantou County 542 (TW)

( * ) Notice: Subject to any disclaimer, the term of this patent is extended or adjusted under 35 U.S.C. 154(b) by 0 days.

(21) Appl. No.: 10/988,574

(22) Filed: Nov. 16, 2004

(51) Int. Cl.
*B25B 13/46* (2006.01)

(52) U.S. Cl. ..... 81/63; 81/63.2

(58) Field of Classification Search ..... 81/60–63.2, 81/58.4

See application file for complete search history.

(56) References Cited

U.S. PATENT DOCUMENTS 3,250,157 A * 5/1966 Badger ..... 81/63
3,733,936 A * 5/1973 Flynn ..... 81/58.1
5,913,954 A * 6/1999 Arnold et al. ..... 81/63.2
5,957,009 A * 9/1999 McCann ..... 81/63.2
6,134,991 A * 10/2000 Chaconas ..... 81/63
6,164,167 A * 12/2000 Chen ..... 81/63.2
6,516,692 B1 * 2/2003 Hsien ..... 81/63.2
6,868,759 B1 * 3/2005 Tuan-Mu ..... 81/63.2
2002/0194965 A1 * 12/2002 Chen ..... 81/63
2003/0079572 A1 * 5/2003 Ho ..... 81/63.2

* cited by examiner

*Primary Examiner*—David B. Thomas
(74) *Attorney, Agent, or Firm*—Rosenberg, Klein & Lee

(57) ABSTRACT

A pawl mechanism of a ratchet wrench, including a wrench main body, a pawl, a ratchet wheel and a shift member. Four engaging recesses are formed on a bottom of a first recess of the wrench main body. A first engaging channel and a second engaging channel are respectively formed on two sides of the pawl corresponding to two of the four engaging recesses of the wrench main body. A spring and a steel ball are disposed in each of the engaging channels, whereby the steel balls can be located in the corresponding engaging recesses of the wrench main body.

5 Claims, 7 Drawing Sheets

PAWL MECHANISM OF A RATCHET WRENCH

BACKGROUND OF THE INVENTION

The present invention is related to an improved pawl mechanism of a ratchet wrench.

FIG. 7 shows a pawl mechanism of a conventional ratchet wrench. The main body 6 of the wrench is formed with a receiving cavity 64 having a recess 61. A compression spring 62 and a dog 63 are embedded in the recess 61. A pawl 7 and a ratchet wheel 8 are mounted in the receiving cavity 64 of the main body 6. The spring 62 serves to resiliently push the dog 63 to abut against one face of the pawl 7. The teeth of the pawl 7 are engaged with the ratchets of the ratchet wheel 8 to dog the ratchet wheel 8.

The above pawl mechanism of the conventional ratchet wrench has some shortcomings as follows:

1. The spring 62 serves to resiliently push the dog 63 to abut against simply one face of the pawl 7. The force exerted onto the pawl 7 by the dog 63 is uneven.
2. When assembling the ratchet wrench, the spring 62 and the dog 63 are embedded in the recess 61 of the main body 6. The spring 62 tends to bound away the dog 63 so that a worker must press the spring 62 and the dog 63 with a finger. Accordingly, during assembling procedure, the dog 63 tends to detach from the recess 61. Also, when disassembled, the spring 62 and the dog 63 tend to bound away. Therefore, it is inconvenient to both assemble and disassemble the pawl mechanism.

SUMMARY OF THE INVENTION

It is therefore a primary object of the present invention to provide an improved pawl mechanism of a ratchet wrench, in which three teeth of the pawl are engaged with three teeth of the ratchet wheel. Therefore, the contact area between the teeth of the ratchet wheel and the teeth of the pawl is enlarged so that the contact pressure created by unit area of the teeth is less than the original contact pressure. Therefore, the unit area strength of the teeth of the pawl and the teeth of the ratchet wheel is enhanced. Accordingly, the wearing of the teeth of the pawl and the teeth of the ratchet wheel is reduced.

It is a further object of the present invention to provide the above pawl mechanism in which a cylindrical boss of the pawl is located in a locating hole of the wrench main body to easily assemble, disassemble and locate the pawl. Accordingly, the assembling time is shortened and the assembling procedure is facilitated.

According to the above objects, the pawl mechanism of the present invention includes a wrench main body, a pawl, a ratchet wheel and a shift member, wherein:

the wrench main body has a head section formed with a first receiving cavity which is composed of a first recess and a first receptacle, the first receiving cavity being formed with a first thread hole and a second thread hole, a bottom of the first recess being formed with a first engaging recess, a second engaging recess, a third engaging recess and a fourth engaging recess, the bottom of the first recess being further formed with a locating hole and a through hole;

a bottom of the pawl has a cylindrical boss, a bottom face of the cylindrical boss being formed with a second receiving cavity, two sides of the pawl being respectively formed with a first engaging channel and a second engaging channel, the pawl further having first teeth and second teeth, the pawl being mounted in the first recess of the first receiving cavity of the wrench main body, the cylindrical boss of the pawl being fitted in the locating hole of the wrench main body to locate the pawl, the first and second engaging channels of the pawl corresponding to a first engaging recess and a third engaging recess of the wrench main body, a first resilient unit and a second resilient unit being respectively disposed in the first engaging channel and second engaging channel of the pawl, the first and second resilient units being respectively composed of a first spring and a first steel ball and a second spring and a second steel ball, one end of each spring abutting against each steel ball, while the other end of each spring protruding from the pawl;

the ratchet wheel is formed with annularly arranged teeth, the ratchet wheel being mounted in the first receptacle of the first receiving cavity of the wrench main body, an upper cover being disposed on the wrench main body to cover the first receiving cavity, the upper cover having a perforation, a third thread hole and a fourth thread hole, a first screw and a second screw being screwed through the first and second thread holes of the wrench main body into the third and fourth thread holes of the upper cover, by means of the upper cover, the pawl and the ratchet wheel being fly mounted in the first receiving cavity of the wrench main body; and the shift member includes a lever and a rotary shaft connected therewith, the rotary shaft being fitted through the through hole of the bottom of the first recess of the wrench main body into the second receiving cavity of the pawl to fixedly connect with the pawl.

The present invention can be best understood through the following description and accompanying drawings wherein:

DETAILED DESCRIPTION OF THE PREFERRED EMBODIMENTS

Figure 1:
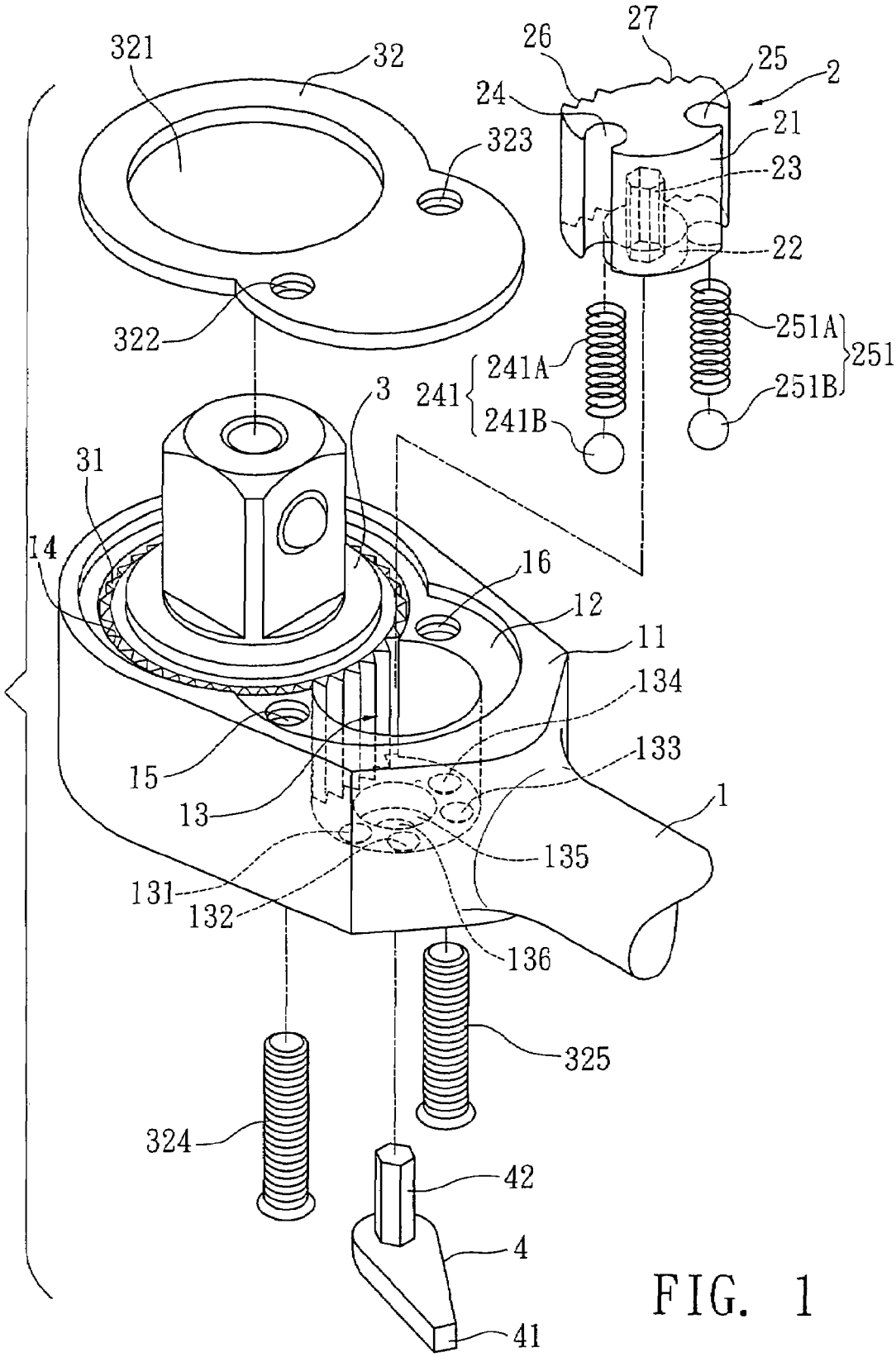
FIG. 1 is a perspective exploded view of a first embodiment of the present invention mounted in a ratchet wrench.
Figure 2:
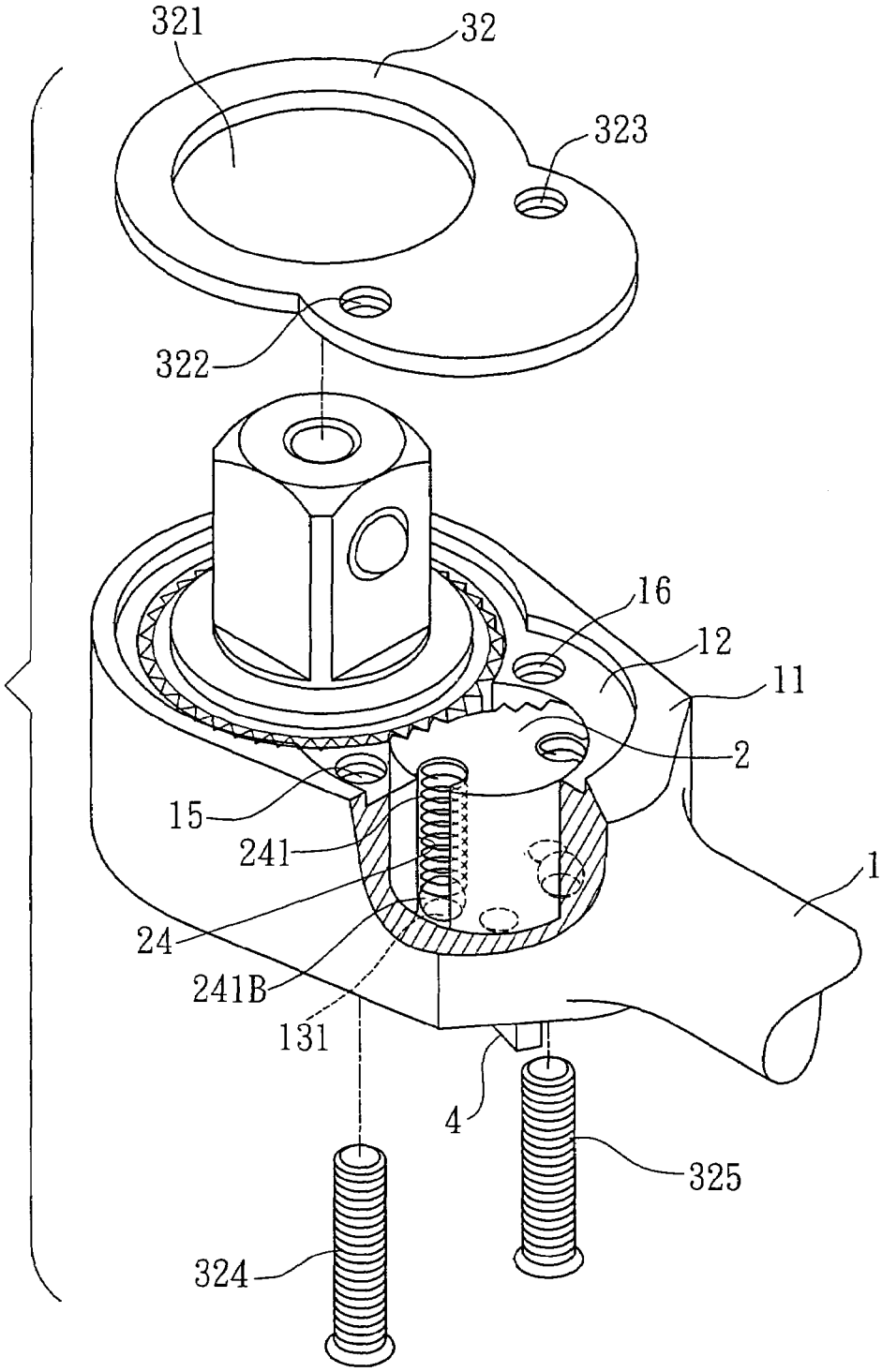
FIG. 2 is a perspective partially exploded view of the first embodiment of the present invention mounted in a ratchet wrench.

Please refer to FIGS. 1 and 2. According to a first embodiment, the pawl mechanism of the ratchet wrench of the present invention includes a wrench main body 1, a pawl 2, a ratchet wheel 3 and a shift member 4.

The wrench main body 1 has a head section 11 formed with a first receiving cavity 12 composed of a first recess 13 and a first receptacle 14. The first receiving cavity 12 is formed with a first thread hole 15 and a second thread hole 16. The bottom of the first recess 13 is formed with a first engaging recess 131, a second engaging recess 132, a third engaging recess 133 and a fourth engaging recess 134. In addition, the bottom of the first recess 13 is formed with a locating hole 135 and a through hole 136.

The bottom 21 of the pawl 2 has a cylindrical boss 22. The bottom face of the cylindrical boss 22 is formed with a second receiving cavity 23. Two sides of the pawl 2 are respectively formed with a first engaging channel 24 and a second engaging channel 25. In addition, the pawl 2 has first teeth 26 and second teeth 27. The pawl 2 is mounted in the first recess 13 of the first receiving cavity 12 of the wrench main body 1. The cylindrical boss 22 of the pawl 2 is fitted in the locating hole 135 of the wrench main body 1 to locate the pawl 2. A first resilient unit 241 and a second resilient unit 251 are respectively disposed in the first engaging channel 24 and second engaging channel 25 of the pawl 2 corresponding to the first engaging recess 131 and third engaging recess 133 of the wrench main body 1. In this embodiment, the first and second resilient units 241, 251 are respectively composed of a first spring 241A and a first steel ball 241B and a second spring 251A and a second steel ball 251B. One end of each spring 241A, 251A abuts against each steel ball 241B, 251B. The other end of each spring 241A, 251A protrudes from the pawl 2.

The ratchet wheel 3 is formed with annularly arranged teeth 31. The ratchet wheel 2 is mounted in the first receptacle 14 of the first receiving cavity 12 of the wrench main body 1. An upper cover 32 is disposed on the wrench main body 1 corresponding to the ratchet wheel 3 and the pawl 2 to cover the first receiving cavity 12. The upper cover 32 has a perforation 321, a third thread hole 322 and a fourth thread hole 323. A first screw 324 and a second screw 325 are screwed through the first and second thread holes 15, 16 of wrench main body 1 into the third and fourth thread holes 322, 323 of the upper cover 32. By means of the upper cover 32, the pawl 2 and the ratchet wheel 3 are firmly mounted in the first receiving cavity 12 of the wrench main body 1.

The shift member 4 includes a lever 41 and a rotary shaft 42 connected therewith. The shift member 4 is mounted at the through hole 136 of the wrench main body 1 with the rotary shaft 42 fixed in the second receiving cavity 23 of the pawl 2.

The first receiving cavity 12 of the head section 11 of the wrench main body 1 is composed of the first recess 13 and the first receptacle 14. The pawl 2 and the ratchet wheel 3 are respectively disposed in the first recess 13 and the first receptacle 14. The cylindrical boss 22 of the bottom 21 of the pawl 2 is positioned in the locating hole 135 of the wrench main body 1 to easily locate the pawl 2. Accordingly, the assembling time is shortened and the assembling procedure is facilitated.

The first teeth 26 or second teeth 27 of the pawl 2 are engaged with the teeth 31 of the ratchet wheel 3 by larger contact area. Therefore, the contact pressure created by unit area of the teeth 26, 27 is less than the original contact pressure. Therefore, the unit area strength of the first and second teeth 26, 27 of the pawl 2 and the teeth 31 of the ratchet wheel 3 is enhanced. Accordingly, the wearing of the first and second teeth 26, 27 of the pawl 2 and the teeth 31 of the ratchet wheel 3 is reduced.

The first and second steel balls 241B, 251B are located along the first and second engaging channels 24, 25 of the pawl 2 into the first and third engaging recesses 131, 133 of the wrench main body 1. The first and second springs 241A, 251A are respectively mounted in the first and second engaging channels 24, 25 of the pawl 2. One end of each spring 241A, 251A abuts against each steel ball 241B, 251B. The other end of each spring 241A, 251A protrudes from the pawl 2. When the upper cover 32 is assembled with the wrench main body 1 to cover the first receiving cavity 12 thereof, the upper cover 32 compresses the springs 241A, 251A into the first and second engaging channels 24, 25 of the pawl 2. The screws 324, 325 are screwed through the first and second thread holes 15, 16 of wrench main body 1 into the third and fourth thread holes 322, 323 of the upper cover 32. By means of the upper cover 32, the pawl 2 and the ratchet wheel 3 are firmly mounted in the first receiving cavity 12 of the wrench main body 1. Accordingly, the assembling time is shortened and the assembling procedure is facilitated.

The rotary shaft 42 of the shift member 4 is fitted through the through hole 136 of the wrench main body 1 and fixedly disposed in the second receiving cavity 23 of the pawl 2. Accordingly, the shift member 4 is integrally assembled with the pawl 2 without easy detachment.

When it is desired to clockwise rotate the ratchet wheel 3, the first steel ball 241B of the first engaging channel 24 of the pawl 2 and the second steel ball 251B of the second engaging channel 25 are turned from the first engaging recess 131 and third engaging recess 133 of the first recess 13 of the wrench main body 1 to left sides of the first engaging recess 131 and the third engaging recess 133. The steel balls 241B, 251B help in pushing the ratchet wheel 3, whereby the first teeth 26 of the pawl 2 instantaneously are not in contact with the teeth 31 of the ratchet wheel 3. When the ratchet wheel 3 stops rotating, the steel balls 241B, 251B restore to the first and third engaging recesses 131 and 133.

Figure 3:
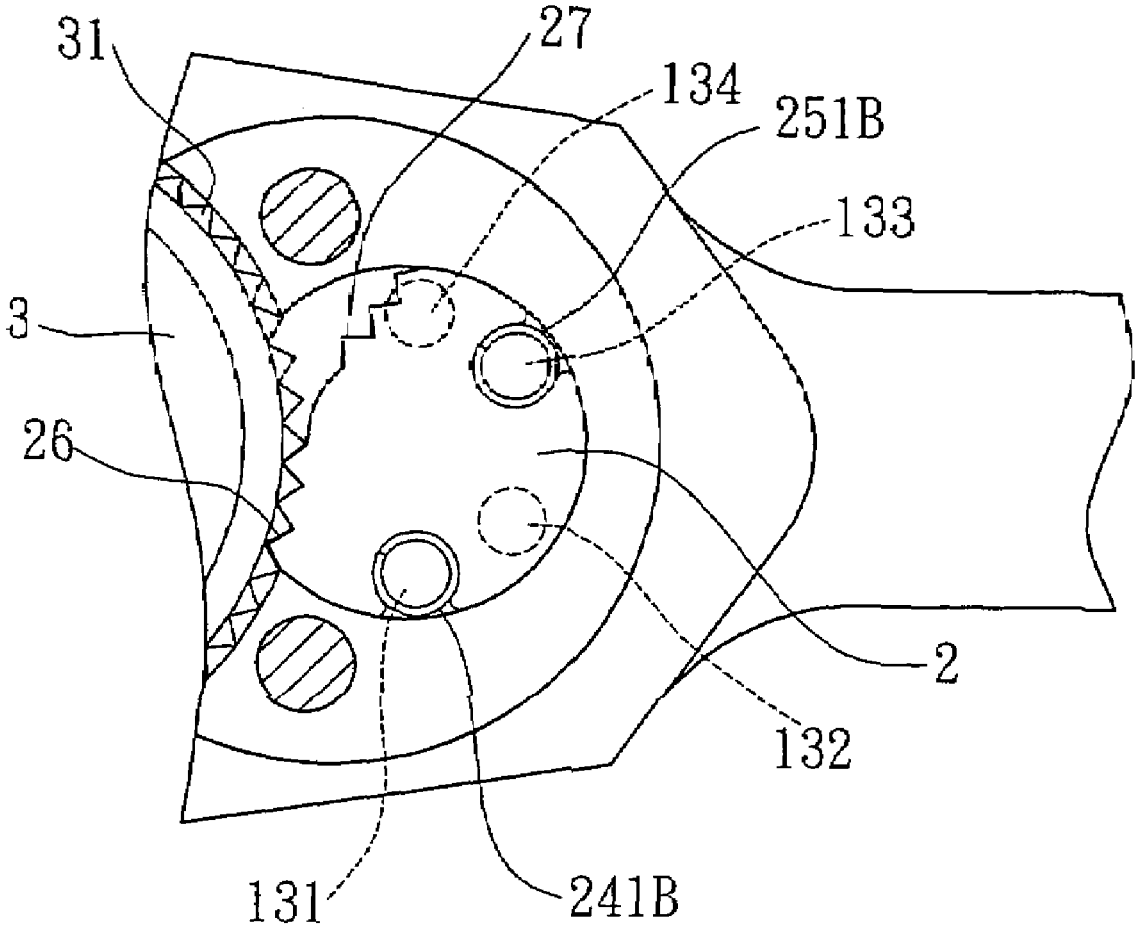
FIG. 3 is a sectional view of the first embodiment of the present invention, showing that the shift member is shifted to change the wrenching direction of the ratchet wrench in one state.
Figure 4:
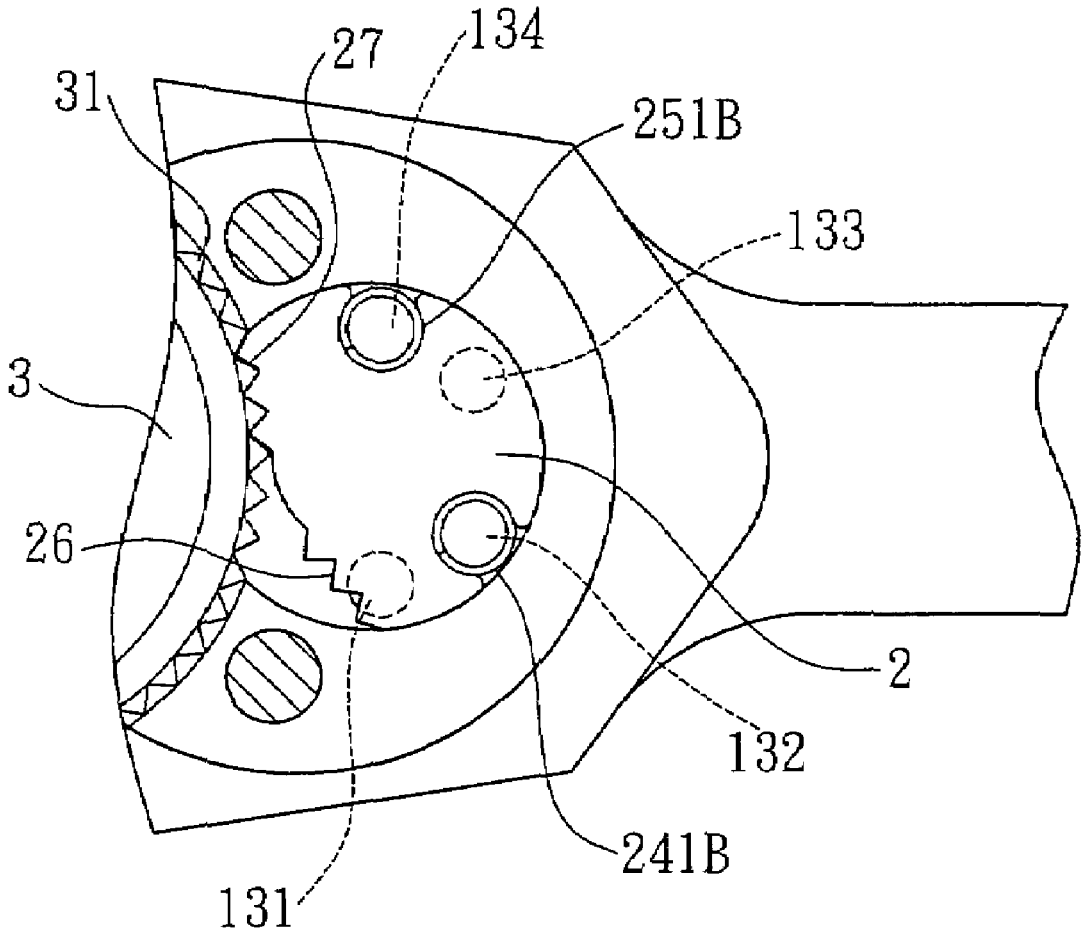
FIG. 4 is a sectional view of the first embodiment of the present invention, showing that the shift member is shifted to change the wrenching direction of the ratchet wrench in another state.

When it is desired to counterclockwise rotate the ratchet wheel 3, referring to FIGS. 3 and 4, the shift member 4 is shifted to turn the first steel ball 241B of the first engaging channel 24 of the pawl 2 and the second steel ball 251B of the second engaging channel 25 from the first engaging recess 131 and third engaging recess 133 of the first recess 13 of the wrench main body 1 to the second engaging recess 132 and the fourth engaging recess 134, (When the pawl 2 is rotated, the steel balls 241B, 251B are turned to compress the springs 241A, 251A.) At this time, the ratchet wheel 3 can be backward rotated.

Figure 5:
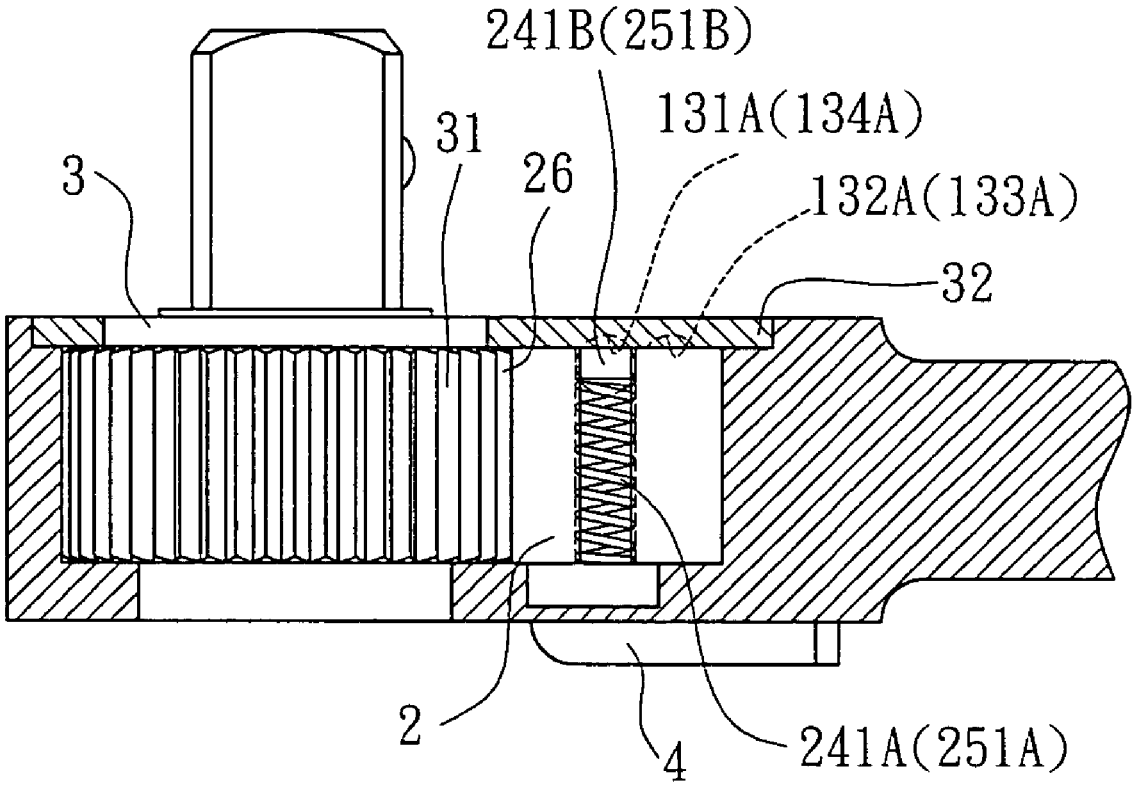
FIG. 5 is a sectional view of a second embodiment of the present invention.
Figure 6:
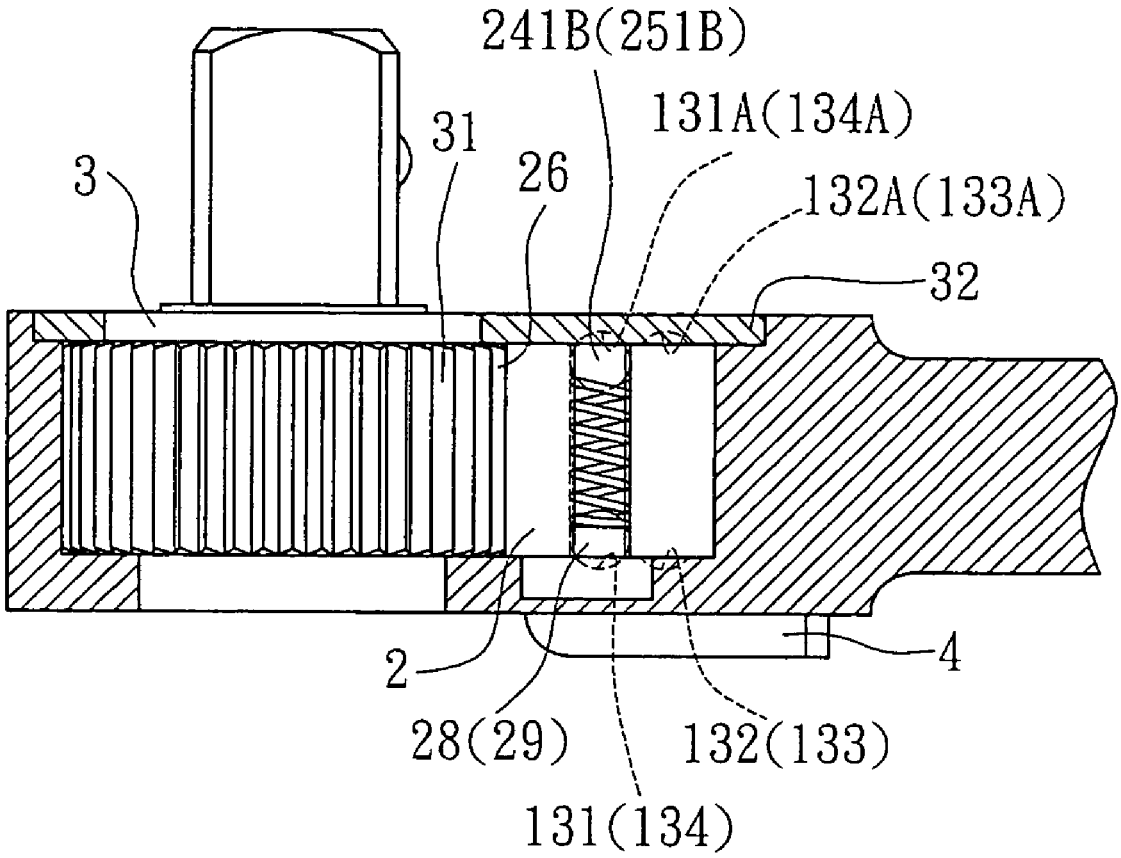
FIG. 6 is a sectional view of a third embodiment of the present invention.
Figure 7:
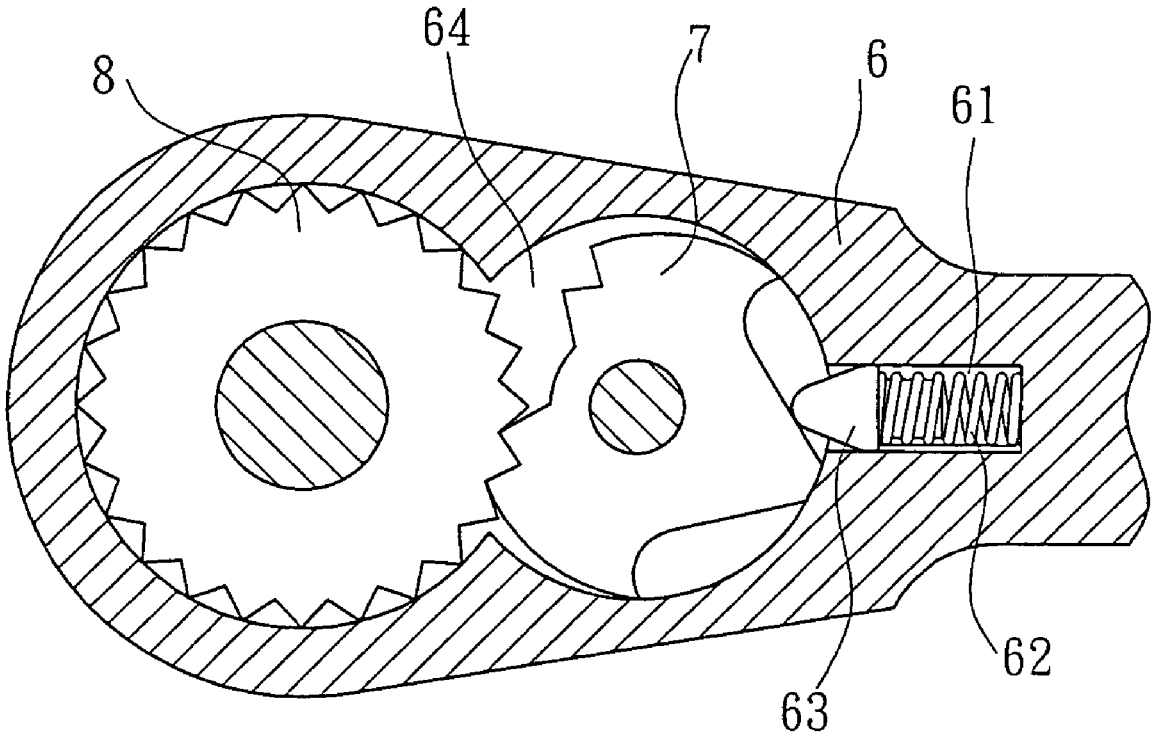
FIG. 7 PRIOR ART
FIG. 7 is a sectional view of a detent mechanism of a conventional ratchet wrench.

FIG. 5 shows a second embodiment of the present invention, in which the first engaging recess 131A, second engaging recess 132A, third engaging recess 133A and fourth engaging recess 134A are formed under bottom face of the upper cover 32. The steel balls 241B, 251B are located at the ends of the springs 241A, 251A facing the upper cover 32. The other ends of the springs 241A, 251A protrude from the pawl 2. The operation of the second embodiment is similar to the first embodiment FIG. 6 shows a third embodiment of the present invention, in which the first engaging recess 131, second engaging recess 132, third engaging recess 133 and fourth engaging recess 134 of the first embodiment cooperate with the first engaging recess 131A, second engaging recess 132A, third engaging recess 133A and fourth engaging recess 134A of the second embodiment. In addition, a third and a fourth steel balls 28, 29 are respectively located at the other ends of the first and second springs 241A, 251A. This can achieve the same effect as the first and second embodiments.

In conclusion, contact area between the teeth of the ratchet wheel and the teeth of the pawl is enlarged so that the contact pressure created by unit area of the teeth is less than the original contact pressure. Therefore, the unit area strength of the teeth of the pawl and the teeth of the ratchet wheel is enhanced. Accordingly, the wearing of the teeth of the pawl and the teeth of the ratchet wheel is reduced. In addition, the cylindrical boss of the pawl is located in the locating hole of the wrench main body to easily assemble/ disassemble the pawl. Accordingly, the assembling time is shortened and the assembling procedure is facilitated.

The above embodiments are only used to illustrate the present invention, not intended to limit the scope thereof. Many modifications of the above embodiments can be made without departing from the spirit of the present invention.

The invention claimed is:

1. A pawl mechanism of a ratchet wrench, comprising:

a wrench main body having a head section formed with a first receiving cavity which is composed of a first recess and a first receptacle, the first receiving cavity being formed with a first thread hole and a second thread hole, a bottom of the first recess being formed with a locating hole and a through hole;

a pawl disposed in the first recess of the wrench main body;

a shift member including a lever and a rotary shaft connected therewith, the rotary shaft being fitted through the through hole of the bottom of the first recess of the wrench main body and integrally connected with the pawl;

a ratchet wheel mounted in the first receptacle of the first receiving cavity of the wrench main body; and an upper cover disposed on the wrench main body corresponding to the ratchet wheel and the pawl and covering the first receiving cavity, said wrench main body including four engaging recesses being located on the bottom of the first recess of the wrench main body, a first engaging channel and a second engaging channel being respectively formed on two sides of the pawl corresponding to two of the four engaging recesses of the wrench main body, a spring and a steel ball being disposed in each of the first and second engaging channels, whereby the steel balls can be located in the corresponding engaging recesses of the wrench main body.

2. The pawl mechanism of the ratchet wrench as claimed in claim 1, wherein a bottom of the pawl has a cylindrical boss, a bottom face of the cylindrical boss being formed with a second receiving cavity, two sides of the pawl being respectively formed with a first engaging channel and a second engaging channel, the pawl further having first teeth and second teeth, the pawl being mounted in the first recess of the first receiving cavity of the wrench main body, the cylindrical boss of the pawl being fitted in the locating hole of the wrench main body to locate the pawl, the first and second engaging channels of the pawl corresponding to a first engaging recess and a third engaging recess of the wrench main body, a first resilient unit and a second resilient unit being respectively disposed in the first engaging channel and second engaging channel of the pawl, the first and second resilient units being respectively composed of a first spring and a first steel ball and a second spring and a second steel ball, one end of each spring abutting against each steel ball, while an opposite end of each spring protrudes from the pawl.

3. A pawl mechanism of a ratchet wrench, comprising:

a wrench main body having a head section formed with a first receiving cavity which is composed of a first recess and a first receptacle, the first receiving cavity being formed with a first thread hole and a second thread hole, a bottom of the first recess being formed with a locating hole and a through hole;

a pawl disposed in the first recess of the wrench main body;

a shift member including a lever and a rotary shaft connected therewith, the rotary shaft being fitted through the through hole of the bottom of the first recess of the wrench main body and integrally connected with the pawl;

a ratchet wheel mounted in the fist receptacle of the first receiving cavity of the wrench main body; and an upper cover disposed on the wrench main body corresponding to the ratchet wheel and the pawl and covering the first receiving cavity, said wrench main body including four engaging recesses located under a bottom of the upper cover, two engaging channels being respectively formed on two sides of the pawl corresponding to two of the four engaging recesses of the upper cover, a spring and a steel ball being disposed in each of the engaging channels, whereby the steel balls can be located in the corresponding engaging recesses of the upper cover.

4. The pawl mechanism of the ratchet wrench as claimed in claim 3, wherein a bottom of the pawl has a cylindrical boss, a bottom face of the cylindrical boss being formed with a second receiving cavity, two sides of the pawl being respectively formed with a first engaging channel and a second engaging channel, the pawl further having first teeth and second teeth, the pawl being mounted in the first recess of the first receiving cavity of the wrench main body, the cylindrical boss of the pawl being fitted in the locating hole of the wrench main body to locate the pawl, the first and second engaging channels of the pawl corresponding to a first engaging recess and a third engaging recess of the upper cover, a first resilient unit and a second resilient unit being respectively disposed in the first engaging channel and second engaging channel of the pawl block, the first and second resilient units being respectively composed of a first spring and a first steel ball and a second spring and a second steel ball, one end of each spring abutting against each steel ball, while an opposite end of each spring protrudes from the pawl.

5. The pawl mechanism of the ratchet wrench as claimed in claim 3, wherein four engaging recesses are formed on the bottom of the first recess of the wrench main body.

* * * * *